US009734977B2

(12) United States Patent
Costello et al.

(10) Patent No.: US 9,734,977 B2
(45) Date of Patent: Aug. 15, 2017

(54) IMAGE INTENSIFIER WITH INDEXED COMPLIANT ANODE ASSEMBLY

(71) Applicant: Intevac, Inc., Santa Clara, CA (US)

(72) Inventors: Kenneth Costello, Union City, CA (US); Kevin Roderick, San Jose, CA (US)

(73) Assignee: INTEVAC, INC., Santa Clara, CA (US)

( * ) Notice: Subject to any disclaimer, the term of this patent is extended or adjusted under 35 U.S.C. 154(b) by 90 days.

(21) Appl. No.: 14/801,807

(22) Filed: Jul. 16, 2015

(65) Prior Publication Data

US 2017/0018391 A1 Jan. 19, 2017

(51) Int. Cl.
*H01J 1/34* (2006.01)
*H01J 9/18* (2006.01)
*H01J 31/26* (2006.01)

(52) U.S. Cl.
CPC *H01J 1/34* (2013.01); *H01J 9/18* (2013.01); *H01J 31/26* (2013.01)

(58) Field of Classification Search
None
See application file for complete search history.

(56) References Cited

U.S. PATENT DOCUMENTS 4,178,528 A 12/1979 Kennedy
4,755,718 A * 7/1988 Patrick ..... H01J 31/505 313/105 CM
5,047,821 A 9/1991 Costello et al.
5,514,928 A * 5/1996 Niewold ..... H01J 9/125 313/103 CM
6,281,572 B1 8/2001 Robbins
(Continued)

FOREIGN PATENT DOCUMENTS

WO 2014/056550 A1 4/2014

OTHER PUBLICATIONS

Spicer, W.E., "Negative Affinity 3-5 Photocathodes: Their Physics and Technology," Applied Physics, vol. 12, Feb. 1977, pp. 115-130.

*Primary Examiner* — Ashok Patel
(74) *Attorney, Agent, or Firm* — Womble Carlyle Sandridge & Rice LLP; Joseph Bach, Esq.

(57) ABSTRACT

An image intensifier and a method of fabrication are disclosed. The image intensifier contains a photocathode assembly (120) including a vacuum window to generate photoelectrons in response to light, a vacuum package (110) and an anode assembly (130) to receive the photoelectrons. The anode assembly is mounted to the vacuum package via a compliant, springy, support structure (160). The anode additionally includes one or more insulating spacers (140) on the surface facing the photocathode so as to precisely index the position of the anode assembly with respect to the photocathode surface. The photocathode and vacuum window assembly is pressed into the vacuum package to generate a sealed leak tight vacuum envelope. During the photocathode assembly to vacuum package assembly pressing operation, the inner surface of the photocathode assembly contacts the insulating spacer/spacers of the anode assembly, thereby compressing the compliant support structure. This structure and assembly method result in a precisely indexed photocathode to anode assembly sealed image intensifier.

19 Claims, 9 Drawing Sheets

(56) References Cited

U.S. PATENT DOCUMENTS

| | | | | |
|---|---|---|---|---|
| 6,285,018 | B1 | 9/2001 | Aebi et al. | |
| 6,837,766 | B2 | 1/2005 | Costello | |
| 6,847,027 | B2 | 1/2005 | Iosue | |
| 6,998,635 | B2 | 2/2006 | Sillmon et al. | |
| 7,479,686 | B2 | 1/2009 | Costello et al. | |
| 7,607,560 | B2 | 10/2009 | Costello | |
| 7,880,128 | B2 | 2/2011 | Garris et al. | |
| 8,698,925 | B2 | 4/2014 | Costello et al. | |
| 2005/0258212 | A1* | 11/2005 | Costello | B23K 1/0016 228/60 |
| 2011/0260608 | A1* | 10/2011 | Rosine | H01J 31/507 313/532 |

* cited by examiner

IMAGE INTENSIFIER WITH INDEXED COMPLIANT ANODE ASSEMBLY

GOVERNMENT SUPPORT

This invention was made with Government Support under Contract No. N00421-11-D-0034 Delivery Order 0004, issued by the Naval Air Warfare Center. The Government has certain rights in the invention.

BACKGROUND

1. Field

This invention is in the field of proximity focused, night vision image intensifiers. Specifically, this invention relates to image intensifiers that produce electrical output signals.

2. Related Art

Intensifiers include, but are not limited to, electron bombarded active pixel sensors (EBAPS) (U.S. Pat. No. 6,285,018 B1) and electron bombarded charge coupled devices (EBCCDs). U.S. Pat. No. 6,285,018 is incorporated by reference into the disclosed background for this patent. These sensors fall into a class of vacuum imaging sensors that predominantly use proximity focused electron optics. Proximity focused sensors typically use planar photocathodes and planar anodes. The image information contained in the intensity pattern of the electrons emitted from the photocathode is transferred across the vacuum gap of the sensor by accelerating the electrons through an electric field. The electric field is established by biasing the photocathode and the anode to different voltages. Typical bias voltages for EBAPS internal components are −1200V on the photocathode and 0V on the anode assembly. As photoelectrons traverse the vacuum gap, they spread from their emission position on the photocathode to a proximate but not exactly translated impact position on the anode assembly. This spreading results in a loss of image sharpness. This loss of image quality is minimized by minimizing the transit time of the electrons across the vacuum gap. Transit time is in turn minimized by minimizing the cathode to anode gap. The improvement in transit time at a given bias voltage must be weighed against other performance attributes that tend to degrade with increasing electric field strength. Specifically, photocathode dark current emission tends to increase with increasing electric field strength. Increased photocathode dark current adversely affects image intensifier performance when used for night vision applications. Typical electric fields employed over photocathodes for proximity focused night vision image intensifiers range from ~3000 to ~8000V/mm. Accurate control of the electric field strength translates into precise dimensional requirements for the components used to manufacture image intensifiers. Specifying precise dimensional tolerances for image intensifier components generally raises production costs for these components.

Anode assemblies for indirect view image intensifiers including EBAPS, EBCMOS and EBCCDs may incorporate collimating structures. U.S. Pat. No. 8,698,925 B2 is incorporated by reference to this patent to document and set a basis for this aspect of the prior art.

One approach image intensifier manufacturers have attempted to use in the past is the use of a spacer attached to the photocathode to specify the vacuum gap that lies immediately above the photocathode and across which the electric field is applied. Iosue (U.S. Pat. No. 6,847,027 B2) describes the use of an insulating spacer which is fabricated as an integral portion of the photocathode manufacturing process. Although the described manufacturing process and structure may achieve the goal of setting a minimum limit to the vacuum gap overlying the photocathode, the design suffers from a number of shortcomings. Perhaps the most important of these issues is cost. The generation of glass bonded photocathodes is as described by Iosue, a relatively complex process. The incorporation of a spacer as an integral piece of the photocathode increases the required handling and processing of the photocathode assembly. The GaAs photoemission surface is quite sensitive to damage and contamination. Increasing the complexity of the manufacture process and the required handling translates into increased component yield loss and consequently increased cost. Additionally, Iosue fails to address issues related to the physical compliance of the surface that is contacted by the spacer. Kennedy (U.S. Pat. No. 4,178,528) describes a room temperature Indium seal as is typically used on image intensifiers as employing forces on the order of 150-200 pounds of force per square inch. During the application of this force the Indium used to insure the vacuum seal between the window and vacuum body assemble is displaced as the gap between the photocathode and an opposing surface is reduced. The perspective to be gained from the previous description is that the force required to damage an MCP as used in the image intensifier described by Iosue or the anode assembly of the present invention is much lower than the force applied to affect the vacuum seal. Consequently, the force versus compliance characteristics of the surface opposing the photocathode during seal specifies the accuracy with which the opposing component must be placed with respect to the photocathode stopping point in order to avoid damage. A failure to design in sufficient compliance will potentially result in: low sensor yield (Adds cost), tight geometric specification requirement for sensor components (Adds cost), and inconsistent forces between the photocathode and the opposing surface present the potential for shock/vibration damage and reliability issues particularly when high voltage gated gain control approaches are used.

Indirect view image intensifiers such as MCP-CMOS (as described in U.S. Pat. No. 7,880,128), EBCCDs (U.S. Pat. No. 6,281,572 Robbins) or EBAPS (U.S. Pat. No. 7,607,560) typically employ multi-layer ceramic headers which constitute a portion of the vacuum package to support the semiconductor anode assemblies. A large variety of approaches have been employed to mount semiconductor die within proximity focused image intensifiers as illustrated by the cited patents. However, with the exception of U.S. Pat. No. 7,607,560, none of the prior art indirect view image intensifier packaging approaches include compliant anode assemblies which index directly to the photocathode assembly. In the case of U.S. Pat. No. 7,607,560, the compliant anode assembly is accomplished via the use of molten braze or solder material between the anode assembly and the vacuum package at the time the photocathode is sealed against the vacuum package assembly. This requirement adds image intensifier processing constraints that are undesirable. Specifically, accurate vacuum temperature control is difficult to accomplish in the hardware required to generate the vacuum seal. Additionally, any jostling during the vacuum sealing process can result in an uncontrolled displacement of the molten braze/solder material resulting in a non-functional image intensifier.

SUMMARY

The following summary of the disclosure is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Disclosed embodiments facilitate a low cost approach to achieve highly accurate cathode to anode assembly dimensional control (<10 micron accuracy) in order to fabricate consistent, high performance, proximity focused image intensifiers. The embodiments include insulating spacers affixed to the surface of the anode assembly that faces the photocathode. Further embodiments give the sensor designer a mechanism by which they can engineer the anode compliance versus force behavior to meet both the mechanical tolerance budget associated with cost-effective sensor components and the minimum required anode assembly to cathode assembly force required to insure that the finished sensor is reliable when exposed to required shock and vibration environments.

Disclosed embodiments include a spring support structure that mounts the anode assembly to the vacuum package assembly. Consequently, the anode is flexibly attached to the packaging. A high stiffness is achieved in the spring support structure to displacements lateral to the direction of the applied spring force. Disclosed embodiments achieve the force versus displacement goals while adding the minimum required size and weight to the image intensifier.

Disclosed embodiments also achieve good heat transfer from the anode assembly to the vacuum package assembly and reliably achieve low leakage currents (<10 nA) between the photocathode assembly and the anode assemble when a high voltage bias (typically ~−1200V) is applied between the photocathode and the anode assembly when the sensor is in a dark environment.

Further embodiments limit the force applied by the spring to the photocathode to a moderate level in order to maintain the reliability of the photocathode to vacuum package, vacuum seal. Disclosed embodiments provide a sufficiently high effective spring constant for the anode assembly such that commercially available wire-bond equipment can generate reliable wire-bonds from the compliant anode assembly to bond pads on an inner surface of the vacuum package.

According to disclosed embodiments, the presence of any molten brazes or solders is eliminated from the image intensifier components at the time of the creation of the vacuum seal. Also, disclosed aspects keep the un-sprung anode assembly weight to a minimum so as to minimize the spring force required to keep anode assembly stationary with respect to the photocathode assembly within a required shock and vibration environment.

Disclosed aspects employ a spacer design that spreads the compressive load associated with the spring over a sufficiently large area of the photocathode assembly to avoid damage to the photocathode assembly at the points of contact.

The above stated aspects and goals have been met, achieved, and validated through initial EBAPS sensor manufacturing and testing. Shock testing has been performed to >500 g's demonstrating that this approach is suitable for the majority of image intensifier applications. Specific exemplary embodiments of the invention are described below and illustrated in the following drawings.

Disclosed aspects include an image intensifier comprising: a vacuum package assembly; a photocathode sealingly attached to the vacuum package assembly to thereby define a vacuum chamber, the photocathode having a bottom face comprising a photo-emissive surface; an anode positioned inside the vacuum chamber, the anode having a front surface comprising an electron sensitive surface, wherein the electron sensitive surface is oriented to face the photo-emissive surface; and, a resilient spring assembly attached in part to the vacuum package assembly and in part to a back surface of the anode. The spring assembly may comprise a unitary spring plate having a first set of bond pads attached to the package assembly and a second set of bond pads attached to the back surface of the anode. Pads of the first set of bond pads may be spatially staggered with pads of the second set of bond pads.

According to further aspects, the resilient spring assembly may be attached in part to the vacuum package assembly and in part to a back surface of the anode using malleable bonding agent. The spring assembly may comprise a plurality of individual springs, each spring attached at one end to a bonding pad on the vacuum package assembly and at opposite end to a bonding pad on the anode.

The spring assembly may be configured to prevent lateral movement of the anode in a direction parallel to the front surface. Also, the spring assembly may be configured to maintain the electron sensitive surface of the anode in registration with the photo-emissive surface of the photocathode.

The image intensifier may further comprise a spacer assembly provided between the photocathode and the front surface of the anode. The spacer assembly may be attached to the front surface of the anode. The spacer assembly may comprise a plurality of spacers, each attached to the front surface of the anode. Alternatively, the spacer assembly may comprise a single spacer having a cut out sized to match the electron sensitive surface of the anode. The single spacer may be attached to the front surface of the anode and may be made of insulating material. The spacer assembly may be configured to contact the bottom face so as to maintain a predetermined separation between the photo-emissive surface and the electron sensitive surface.

According to further aspects, an image intensifier is provided, comprising: a vacuum package assembly; a photocathode sealingly attached to the vacuum package assembly to thereby define a vacuum chamber, the photocathode having a bottom face comprising a photo-emissive surface; an anode is flexibly positioned inside the vacuum chamber, the anode having a front surface comprising an electron sensitive surface, wherein the electron sensitive surface is oriented to face the photo-emissive surface; and, a spacer assembly attached to the front surface of the anode and contacting the bottom face of the photocathode so as to maintain a predetermined separation between the photo-emissive surface and the electron sensitive surface.

The spacer assembly may comprise a plurality of spacers, each attached to the front surface of the anode. The spacer assembly may also comprise a single spacer having a cut out sized to match the electron sensitive surface of the anode. The spacer assembly may comprise insulating material. The image intensifier may further comprise a resilient spring assembly attached in part to the vacuum package assembly and in part to a back surface of the anode. The spring assembly may comprise a unitary spring plate having a first set of bond pads attached to the package assembly and a second set of bond pads attached to the back surface of the anode.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

The invention is best understood when the detailed descriptions are referenced to the accompanying set of drawings. The drawings include the following figures.

DETAILED DESCRIPTION

Figure 1:
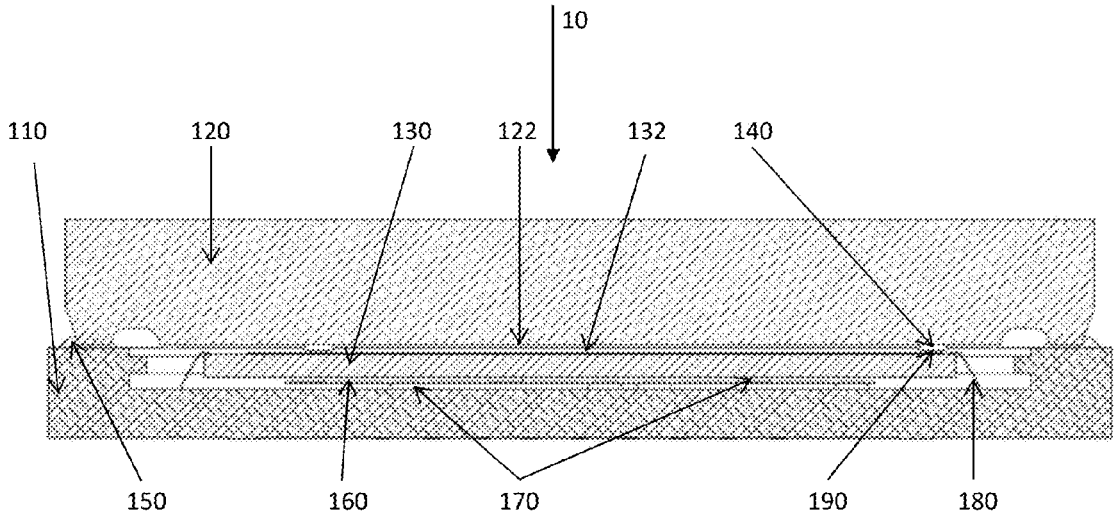
FIG. 1 shows a cross section of an image intensifier according to an exemplary embodiment of the invention.

FIG. 1 shows a cross-sectional view of an EBAPS image intensifier incorporating an exemplary embodiment of the invention. The vacuum package assembly (110) is typically based on a hermetic, multi-layer, high temperature co-fired ceramic package fabricated via conventional means. As shown in FIG. 1, the ceramic package employs a ceramic design protected under the claims of U.S. Pat. No. 6,837,766. As detailed in U.S. Pat. No. 6,837,766 B2, the non-monotonically varying inner ceramic side wall of the vacuum package increases the high voltage stand-off potential of the wall and therefore improves sensor yield. U.S. Pat. No. 6,837,766 B2 is incorporated by reference. The vacuum package (110) assembly is sealed to a photocathode assembly (120) by means of a sealing material (150) in order to complete a vacuum envelope. The vacuum envelope encloses an anode assembly (130). The photo-emissive portion of the photocathode assembly resides on the inner surface of the assembly (122) facing the electron sensitive portion of the anode assembly (132). The photo-emissive portion of the photocathode (122) is typically planar. Light enters the sensor through the photocathode assembly (120) about an optical axis (10) that is essentially perpendicular to the planar photo-emissive surface (122). Detected light is absorbed at the photo-emissive surface (122) resulting in a significant probability of photoelectron emission. Photon absorption and photoelectron emission are typically spatially correlated to within a few microns for the GaAs photocathode used in the exemplary embodiment. The basic physics of the GaAs Photocathode is described in publication: Applied Physics 12, 115-130 (1977) by William E Spicer: Negative Affinity 3-5 Photocathodes: Their Physics and Technology. The electron sensitive surface of the anode assembly may be optionally overlaid with a collimator as detailed in U.S. Pat. No. 8,698,925. This facing arrangement of the photocathode and anode assembly is typical of proximity focused image intensifiers. In U.S. Pat. No. 6,998,635 B2 Sillmon gives a detailed description of a GaAs/AlGaAs photocathode assembly using an advanced filter structure. A preferred embodiment of the invention incorporates a GaAs/AlGaAs photocathode assembly similar to that described by Sillmon. It should be noted that the filter structure, although it may add advantage to certain system level applications, is not material to the present invention. U.S. Pat. No. 6,998,635 is incorporated by reference as background on suitable photocathode assemblies. Other photocathode assembly types and variations may be incorporated without violating the teachings of this disclosure. Specifically, the photocathode assembly may incorporate a Transferred Electron photocathode similar to that described in U.S. Pat. No. 5,047,821. Additionally, a semitransparent alkali photocathode such as that described in patent application WO2014056550 would be applicable to the teachings of this invention. The sealing material (150) may be indium or an alloy of indium as described in U.S. Pat. No. 4,178,528 as described by Kennedy. Other sealing methods to include braze seals, solder seals or other direct metal to metal seals may also be used without violating the teachings of this disclosure. The anode assembly (130) is physically supported by and joined to the vacuum package assembly via one or more springs (160) to facilitate a controlled compliance versus force response as the anode assemble is pushed into the internal cavity of the vacuum package as seen in the cross section if FIG. 1. This provides a flexible attachment of the anode to the packaging. In this exemplary embodiment, the spring is brazed or soldered to both the anode assembly (130) and the vacuum package assembly (110). The braze or solder material (170) may be chosen from a wide variety of materials familiar to those skilled in the art of ultra-high vacuum (UHV) die attach. Suitable materials for the braze/solder attach material (170) include indium, indium alloys, and a wide variety of commercially available metal alloys which include "active" braze materials containing titanium or other reactive metals. Use of an active braze material can negate the need for metallized pads on to package or on the back surface of the anode assembly. It should be noted that the physical height of the braze material (170) is engineered such that the spring (160) can deflect a sufficient distance without contacting the package or alternately contacting the back surface of the anode assembly when the photocathode assembly to package assembly vacuum seal is generated. Also as shown in FIG. 1, in the exemplary embodiment, the points of attachment between the spring (160) and the anode assembly (130) are spatially staggered with the points of attachment between the spring (160) and the vacuum package assembly (110). This configuration is essentially a modified leaf spring. In the exemplary embodiment, a preferred braze or solder material (170) will be slightly malleable using a malleable bonding agent. This malleability limits the peak stress in the spring (160) at the edge of the contact area between the materials. Indium is a preferred braze/solder material (170). Electrical connections from the anode assembly to the inner surface of the vacuum package either via wire bonds (180), through the braze/solder (170) and spring (160) or both paths. Multiple electrically isolated springs may be arrayed below the anode assembly to provide multiple isolated electrical paths to the anode assembly to support signal and power connections. Similarly, metallized traces on an insulating spring substrate may be used in conjunction with vias to make use of the spring as an electrical redistribution layer. However, wire-bonds typically offer the most cost effective and reliable approach to deal with the high lead counts common on high performance CMOS based anode assemblies. FIG. 1 also depicts insulating spacers (140) which are attached to the anode assembly via bonding material (190). Materials that can be used for insulating spacer (140) include but are not limited to glass, quartz, sapphire, alumina, mullite, $SiN_x$, $AlN_x$, $AlN_xO_y$ and a wide variety of other minerals and ceramics. The bonding material (190) can likewise be a braze or solder including In, InSn, InAg, InCu, InPb, SnPb, InPbAg, AuSn, AuGe, AuSi, AlGe, combinations of the previously listed materials or a wide variety of other commercially available bonding materials. The contact, shown in FIG. 1, between the insulating spacer (140), of the anode assembly, and the photocathode assembly (120) results from the force created by the deflection of the spring (160) during the vacuum sealing process.

Figure 8:
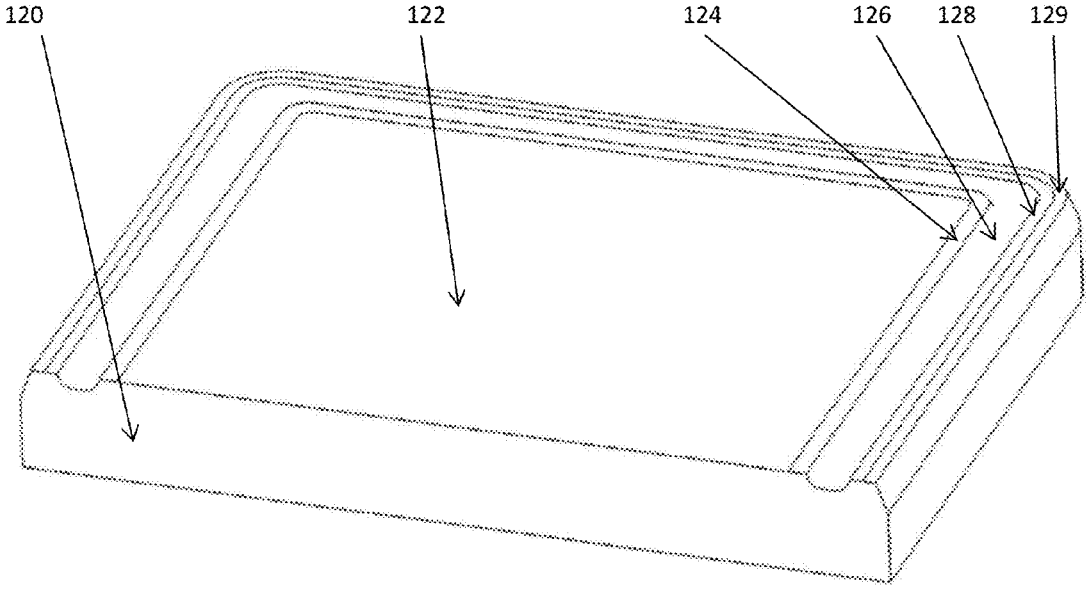
FIG. 8 shows a sectioned view of the photocathode assembly.

FIG. 8 is a cross-sectioned sketch of photocathode assembly (120) that shows additional features that are not visible in FIG. 1. Incoming light travels through photocathode assembly (120) and is at least partially absorbed by the photo-emissive material located in the area depicted as 122 on the surface of the photocathode assembly. In the exemplary embodiment depicted in FIG. 8 the exposed photo-emissive surface consists of P-Type GaAs. Numerous other photo-emissive surfaces may be used without violating the teachings of this invention. 124 indicates a contact area that is nominally co-planar to the photo-emissive surface. 126 indicates a conductive surface coating a trough that separates the plateau consisting of surface 122 combined with 124 and a vacuum seal surface consisting of combined surfaces 128 and 129. The area indicated by 128 is coated with a conductive layer. Section 129 is nominally coplanar with section 128 but is not coated with a conductive layer. Section 129 may be a bare glass surface. For the exemplary embodiment depicted in FIG. 8, Corning Code 7056 glass is demonstrated to be an appropriate material. The conductive layer extending over the surfaces depicted by 124, 126 and 128 is a continuous layer. The layer is typically a metal. Numerous metals may provide an acceptable contact layer. Potential candidate metals include but are not limited to Cr, Co, Ag, Au, Pt, Ir, Ni, Ti, Ta, W, V, Zr, Fe, Al, Cu, C, Si and alloys of the previously listed materials. The layer must have sufficient conductivity to replenish the photoelectrons emitted from photo-emissive surface 122. Typical contact layer thicknesses are on the order of 0.05 to 2 microns. Consequently, photo-emissive surface 122 is essentially co-planar with contact layer 124. It should be noted that spacer 140 may overlay photo-emissive surface 122, contact layer 124 or a combination of both areas without adverse consequence.

Figure 2:
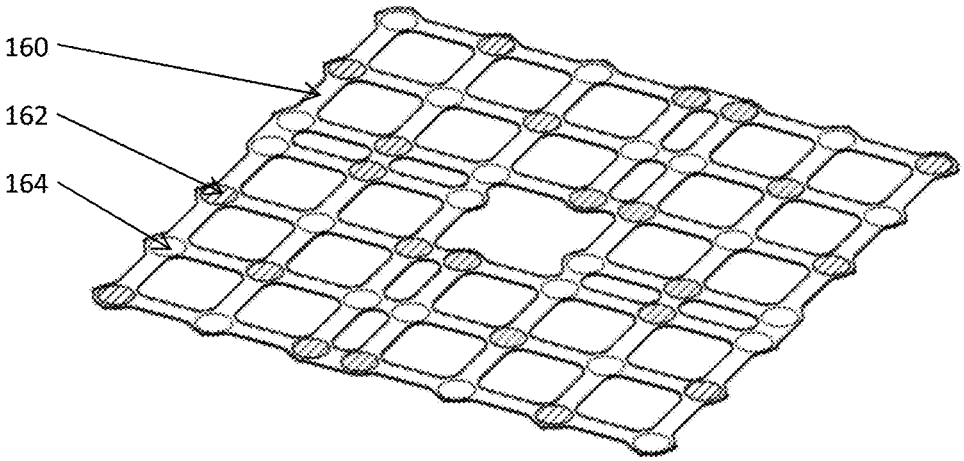
FIG. 2 shows an exemplary spring suitable to facilitate an engineered compliance when used to support a semiconductor anode assembly.
Figure 3:
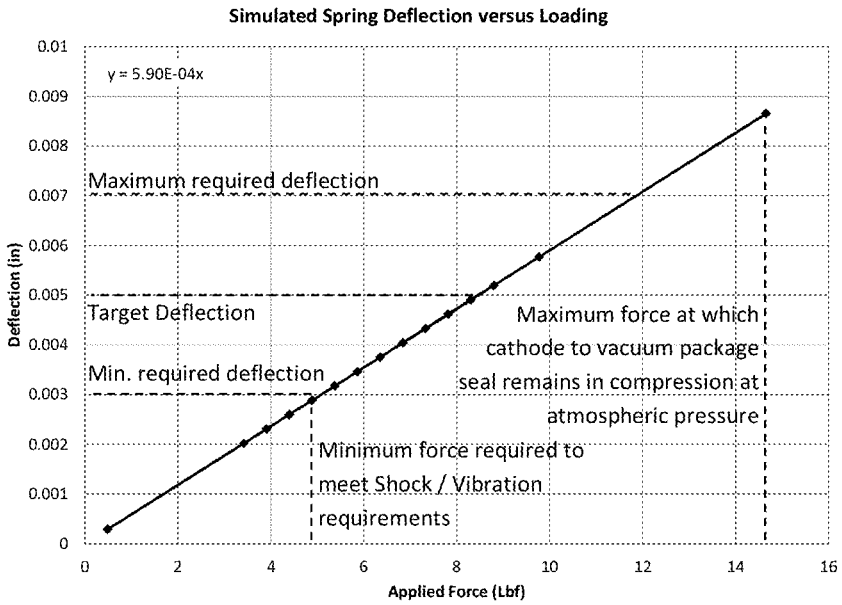
FIG. 3 shows the simulated force versus compliance response for the exemplary spring of FIG. 2.

FIG. 2 depicts an exemplary embodiment of an appropriate spring (160) that can be used to support an anode assembly. The spring may be manufactured from a variety of materials including ceramics, silicon, oxidized silicon, glass, metallized glass, nitrided silicon, nickel, cobalt, metal alloys such as steel, Kovar, beryllium copper, Ni—Co and Fe—Co. A selection of materials not specifically called out in the list above may be made based on favorable mechanical and thermal properties without violating the teachings of this disclosure. Manufacturing methods for the spring can include etching, machining, laser cutting, electroforming and additive 3D printing. The spring does not need to be flat when uncompressed. In fact, a spring that is formed in the unloaded state can be designed to make very efficient use of the volume between the vacuum package assembly and the anode assembly. In order to achieve repeatable braze or solder profiles, pre-defined braze/solder pads are used in a preferred embodiment. The braze pads visible on the exposed surface (162) of FIG. 2 are depicted by cross-hatched circles. The projection of the braze pads present on the hidden face of FIG. 2 are depicted by the open circles (164). The layout and thickness of the spring was based on the mechanical properties of the chosen material. The exemplary layout used an electroformed Cobalt-Nickel alloy, with a 50 micron thickness. Computer modeling of the spring design depicted in FIG. 2 demonstrated that it exhibited sufficient thermal conductivity for the power dissipation of the CMOS device used in the anode assembly. Additionally, computer modeling showed that the chosen design would achieve the compliance performance shown in FIG. 3 without experiencing peak stresses that exceed the material's limits. It is a goal of the sensor design to minimize movement of the anode assembly (130) with respect to both the vacuum package assembly (110) and the photocathode assembly (120) as the sensor is exposed to environmental shocks and vibration. The total effective "sprung mass" for the anode assembly was calculated and compared to the forces generated by the anticipated peak acceleration environmental exposure for the sensor. As the sensor is accelerated parallel to the optical axis (10), the vector product of the mass and the acceleration will sum with the force applied by the spring (160) and transmitted through the anode assembly (130) to the spacers (140). If the forces associated with acceleration of the sensor fully compensate the force applied by the spring (160), movement may occur between the anode assembly (130) and the balance of the sensor. This analysis, including an engineering margin of safety, was used to specify the minimum force required from the spring. The maximum force that was chosen for this exemplary embodiment was chosen to be equal to the sea-level atmospheric force pressing the photocathode assembly in to the vacuum package assembly. This is a somewhat arbitrary upper force limit but it was chosen as a conservative limit. With both force and deflection goals established, the geometry and thickness of the spring layout was iterated until the deflection versus force profile depicted in FIG. 3 was obtained. The minimization of movement between the anode assembly (130) and the balance of the vacuum sensor under the influence of accelerations on an axis perpendicular to the optical axis (10) is insured by multiple means. First, the design of the spring (160) is very resistant to deflection in the plane perpendicular to the optical axis. The exemplary spring shown in FIG. 2 was modeled and predicted to deflect less than one micron for the maximal anticipated acceleration perpendicular to the optical axis. Additionally, the force generated by the spring (160) results in a compressive load between the inner surface of the photocathode assembly (120) and the surface of spacer (140). The coefficient of friction between the spacer (140) and the photocathode assembly (120) surface resists shearing between the two surfaces. This configuration has been shown to pass required shock and vibration environmental exposures without visible degradation. Whereas the described embodiment is highly resistant to movement between anode assembly (130) and the balance of the sensor in high acceleration environments it will accommodate relative movements of the components associated with temperature cycling and mismatched coefficients of thermal expansion.

Figure 4:
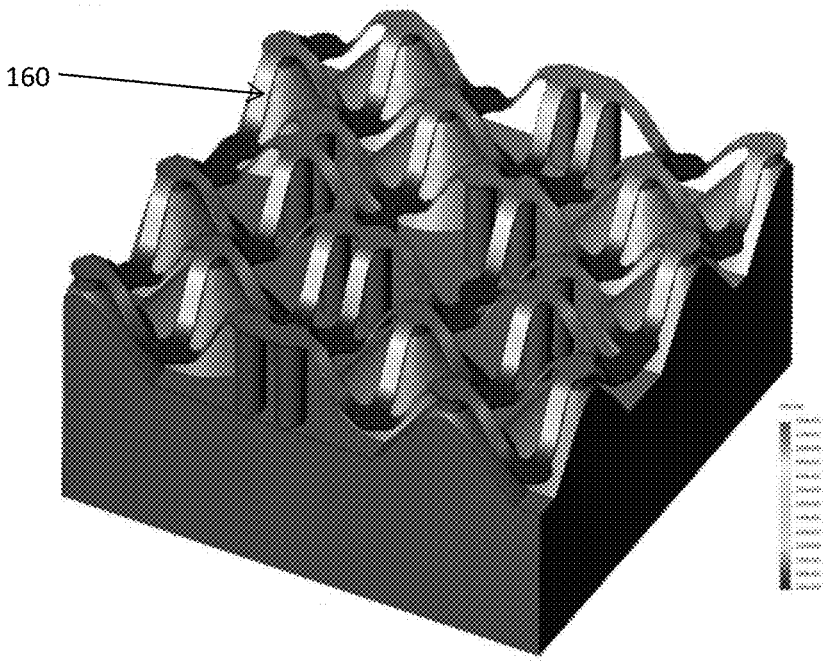
FIG. 4 shows a highly exaggerated simulated deflection for the exemplary spring of FIG. 2 when loaded with forces similar to those experienced in the inventive application. The base shown in the figure is simply part of the simulation and does not represent the current invention. This figure is included to aid the reader to visualize the functionality of the spring.

FIG. 4 shows a sketch of modeled deflection of spring (160) on a test stand with highly exaggerated deflection, it is meant as a guide to illustrate method of function of the spring in the exemplary embodiment. Whereas this geometry meets the thermal and mechanical requirements of the exemplary invention, it will be clear to one skilled in the art that numerous alternate acceptable spring designs may be created without violating the teachings of this disclosure.

Figure 5:
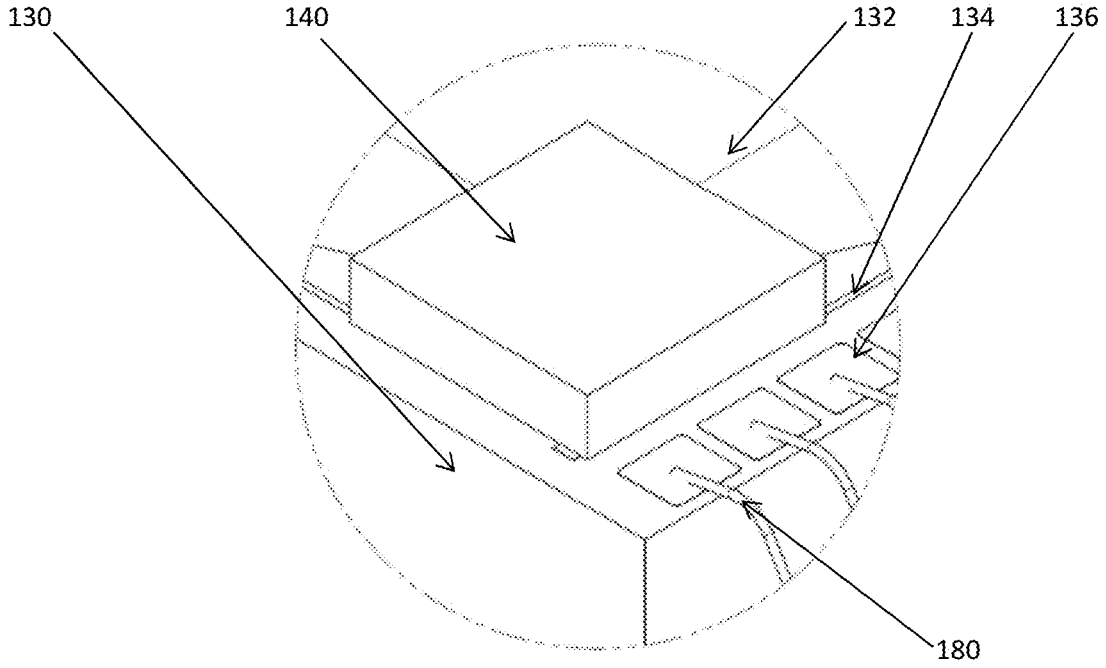
FIG. 5 depicts an exemplary insulating spacer brazed or soldered to an outer corner of the anode assembly.

FIG. 5 shows a close-up view of an insulating spacer 140 positioned at a corner of an anode assembly 130. In this view the photocathode assembly is not present so that the detail of the anode assembly can be better visualized. The projection of the electron sensitive imaging area of the anode assembly is depicted by the surface labeled as 132. Insulating spacer 140 is sized and placed so as to not overlap area 132. In this exemplary embodiment, the anode assembly includes a collimator as indicated by 134. Although, not visible in the view of FIG. 5, the insulating spacer 140 is soldered or brazed to the collimator, as depicted in FIG. 1. The collimator is in turn either formed monolithically from the silicon of the back-thinned CMOS sensor as described in U.S. Pat. No. 7,479,686 or bonded to the anode surface as described in U.S. Pat. No. 7,479,686 or 8,698,925. Wire bond pads are depicted in FIG. 5 and labeled 136. Bond wires (180) that electrically connect anode assembly pads 136 to wire bond pads on the internal surface of the vacuum package assembly (138 FIG. 6) are typically routed to have a very low rise above the surface of the bond pads (136). This minimizes the electric field strength above the bond wares and thereby minimizes the chance that field emission from particles or sharp features on the inner surface of the photocathode assembly (120 FIG. 1) will damage the sensor. In practice, the bond wire height is typically below that of the bottom surface of the insulating spacer 140.

Figure 6:
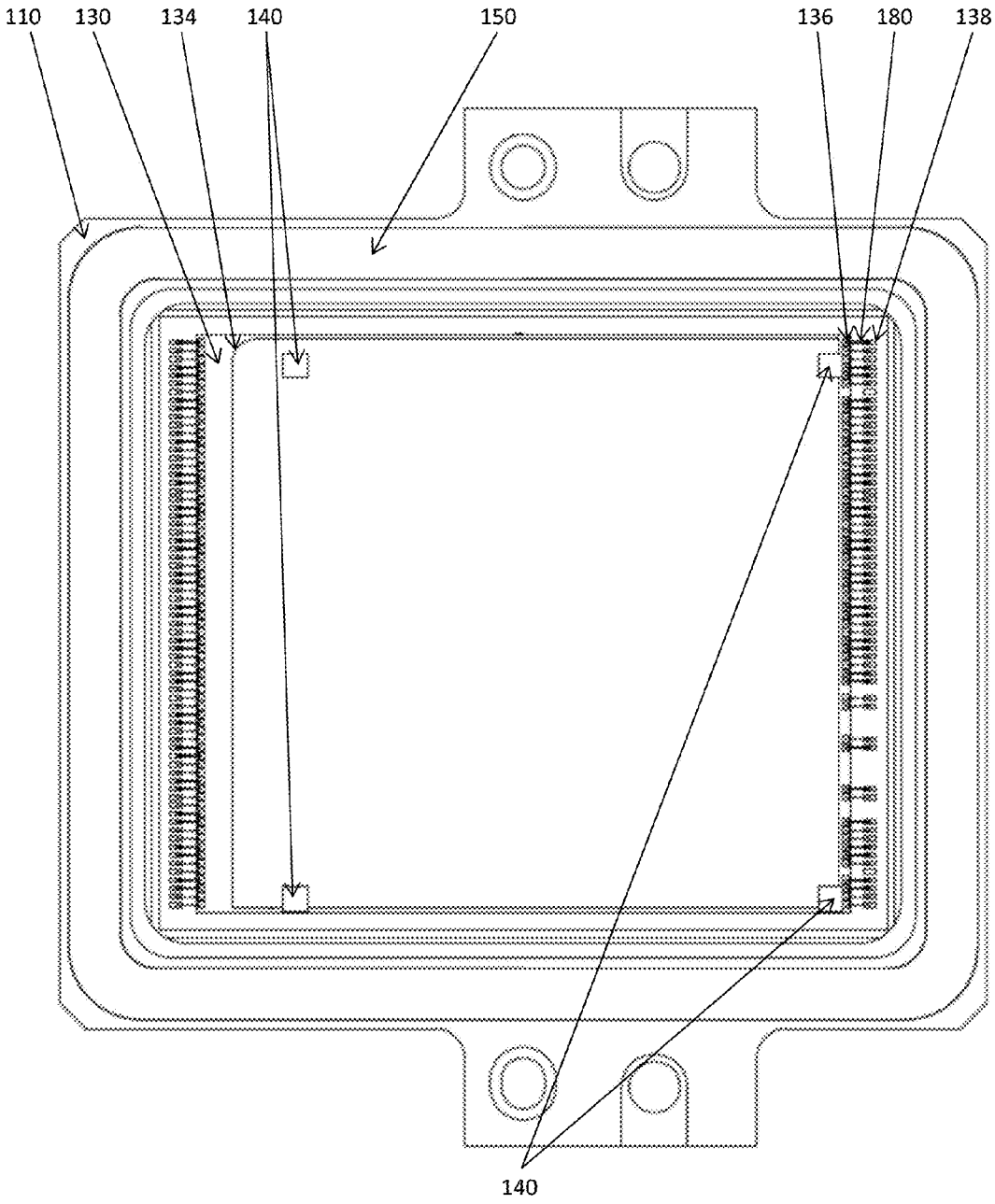
FIG. 6 shows a view of a combined vacuum package and anode assembly. The view is presented from the direction typically covered by the photocathode. The view shows an exemplary embodiment that makes use of 4 insulating spacers.

FIG. 6 shows a perspective view of the vacuum package assembly combined with an anode assembly. In this exemplary embodiment, 4 insulating spacers 140 are used. As shown, the placement of the spacers need not be symmetrical. However, the force generated by the spring must be engineered such that the compliant anode assembly will index off of the photocathode assembly and lay flat against the planar photocathode assembly surface upon completion of the photocathode to vacuum package assembly joining process. A wide variety of braze or solder materials may be used as the bonding material 190 to join the insulating spacers 140 to the underlying anode assembly 130. Low vapor pressure, low melting-point brazes or solder alloys are preferred at this location due to the limited thermal budget associated with a typical CMOS anode assembly. Choice of insulating spacer geometry, material, anticipated thermal processing and spacer count may influence the choice of bonding material 190. Typically a minimum of three spacers (140), or three attachment placements of bonding material (190) to a single spacer are required to robustly specify the relative plane of the anode assembly with respect to the plane of the photocathode assembly (120). The use of a malleable braze material such as is typical of Indium and certain indium alloys for bonding material 190 holds a practical advantage in that a moderate lack of planarity between spacer (140) and the photocathode assembly surface (122 or 124) can be accommodated during the photocathode assembly (120) to vacuum package assembly (110) joining process via deformation of bonding material (190).

Figure 7:
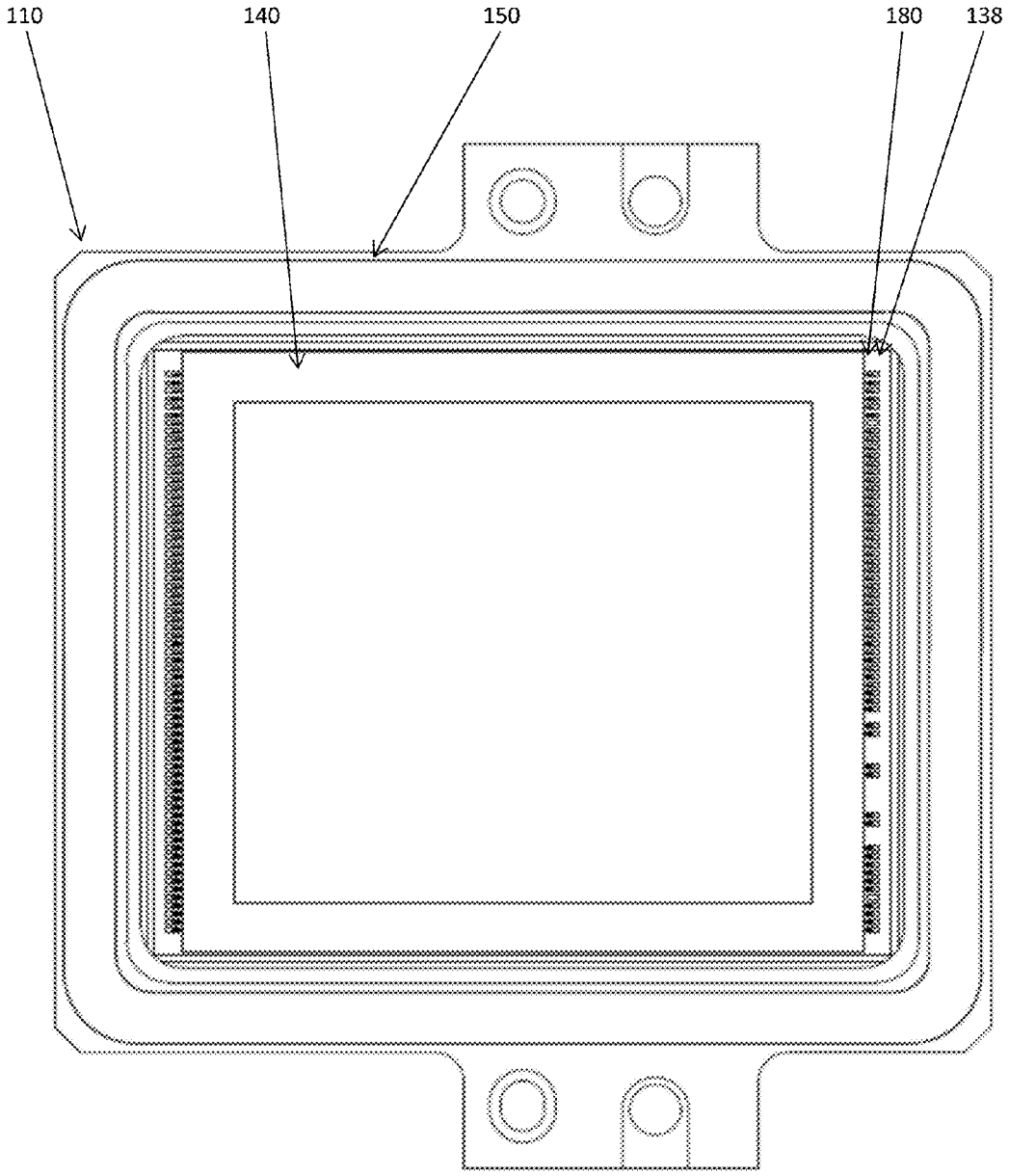
FIG. 7 shows a view of a combined vacuum package and anode assembly suitable for use in an alternate embodiment of the present invention. The view is presented from the direction typically covered by the photocathode. The view shows an exemplary embodiment that makes use of a single insulating spacer.

The relative spacing of the bond wires 180 and the spacer 140 allows the spacer to be positioned over the bond wires without interference. In an alternate embodiment of the invention, the 4-insulating-spacer configuration shown in FIG. 6 is replaced by a single insulating spacer in FIG. 7. The spacer of FIG. 7 is made as a single pad having a cutout matching the size of the electron sensitive surface of the anode. As illustrated in FIG. 7 the spacer can overlap the bondwires. It will be clear to one skilled in the art that a wide variety of spacer configurations and geometries can be implemented when careful consideration is given to materials, thermal coefficients of expansion and anticipated acceleration loads.

Figure 9:
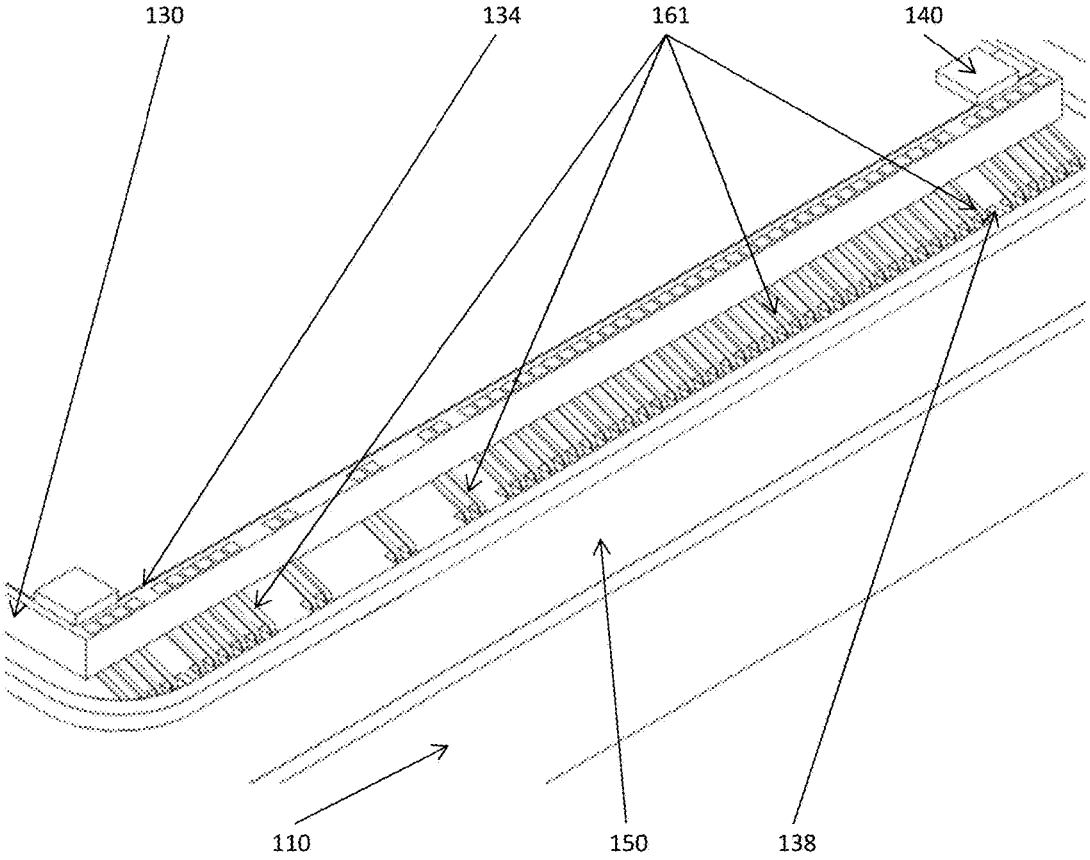
FIG. 9 shows a close-up of a portion of a vacuum package assembly joined to an anode assembly using an alternate multiple spring approach.

FIG. 9 shows an alternate embodiment of a combined vacuum package assembly and anode assembly suitable for use in the current invention. In the exemplary embodiment shown in FIG. 9 a number of potential modifications to the previously shown preferred embodiment are illustrated. First, the monolithic compliant spring 160 shown in FIGS. 1, 2 and 4 has been replaced with multiple spring elements 161. Second, bond wires, 180, have been functionally replaced by the individual, electrically independent spring elements. In FIG. 9, spring elements 161 are affixed to vacuum package bond pads 138. The spring elements additionally contact and are affixed to bond pads present on the back of anode assembly 130. The springs may be affixed to the pads by various means including but not limited to thermo-compression bonding, solder and brazing. Bond pads on the back of the anode assembly may be generated by a number of methods known to those skilled in the art without impacting the scope of teaching in this disclosure. Potential methods to generate backside bond pads include the use of through-silicon vias and wrap around metallizations as described in U.S. Pat. No. 7,607,560 B2.

It should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein.

The present invention has been described in relation to particular examples, which are intended in all respects to be illustrative rather than restrictive. Those skilled in the art will appreciate that many different combinations of hardware, software, and firmware will be suitable for practicing the present invention. Moreover, other implementations of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. An image intensifier comprising:

a vacuum package assembly;

a photocathode sealingly attached to the vacuum package assembly to thereby define a vacuum chamber, the photocathode having a bottom face comprising a photo-emissive surface;

an anode positioned inside the vacuum chamber, the anode having a front surface comprising an electron sensitive surface, wherein the electron sensitive surface is oriented to face the photo-emissive surface; and, a resilient spring assembly attached in part to the vacuum package assembly and in part to a back surface of the anode.

2. The image intensifier of claim 1, wherein the spring assembly comprises a unitary spring plate having a first set of bond pads attached to the package assembly and a second set of bond pads attached to the back surface of the anode.

3. The image intensifier of claim 2, wherein the spring assembly wherein pads of the first set of bond pads are spatially staggered with pads of the second set of bond pads.

4. The image intensifier of claim 1, wherein the resilient spring assembly is in part to the vacuum package assembly and in part to a back surface of the anode using malleable bonding agent.

5. The image intensifier of claim 1, wherein the spring assembly comprises a plurality of individual springs, each spring attached at one end to a bonding pad on the vacuum package assembly and at opposite end to a bonding pad on the anode.

6. The image intensifier of claim 1, wherein the spring assembly is configured to prevent lateral movement of the anode in a direction parallel to the front surface.

7. The image intensifier of claim 1, wherein the spring assembly is configured to maintain the electron sensitive surface of the anode in registration with the photo-emissive surface of the photocathode.

8. The image intensifier of claim 1, further comprising a spacer assembly provided between the photocathode and the front surface of the anode.

9. The image intensifier of claim 8, wherein the spacer assembly is attached to the front surface of the anode.

10. The image intensifier of claim 8, wherein the spacer assembly comprises a plurality of spacers, each attached to the front surface of the anode.

11. The image intensifier of claim 8, wherein the spacer assembly comprises a single spacer having a cut out sized to match the electron sensitive surface of the anode.

12. The image intensifier of claim 11, wherein the single spacer is attached to the front surface of the anode.

13. The image intensifier of claim 8, wherein the spacer assembly comprises insulating material.

14. The image intensifier of claim 8, wherein the spacer assembly is configured to contact the bottom face so as to maintain a predetermined separation between the photo-emissive surface and the electron sensitive surface.

15. An image intensifier comprising:

a vacuum package assembly;

a photocathode sealingly attached to the vacuum package assembly to thereby define a vacuum chamber, the photocathode having a bottom face comprising a photo-emissive surface;

an anode flexibly positioned inside the vacuum chamber, the anode having a front surface comprising an electron sensitive surface, wherein the electron sensitive surface is oriented to face the photo-emissive surface;

a resilient spring assembly attached in part to the vacuum package assembly and in part to a back surface of the anode; and, a spacer assembly attached to the front surface of the anode and contacting the bottom face of the photocathode so as to maintain a predetermined separation between the photo-emissive surface and the electron sensitive surface.

16. The image intensifier of claim 15, wherein the spacer assembly comprises a plurality of spacers, each attached to the front surface of the anode.

17. The image intensifier of claim 15, wherein the spacer assembly comprises a single spacer having a cut out sized to match the electron sensitive surface of the anode.

18. The image intensifier of claim 15, wherein the spacer assembly comprises insulating material.

19. The image intensifier of claim 15, wherein the spring assembly comprises a unitary spring plate having a first set of bond pads attached to the package assembly and a second set of bond pads attached to the back surface of the anode.

* * * * *